US006935418B1

(12) United States Patent
Valaszkai et al.

(10) Patent No.: US 6,935,418 B1
(45) Date of Patent: Aug. 30, 2005

(54) FLUID CONVEYING TUBE AND VEHICLE COOLER PROVIDED THEREWITH

(75) Inventors: Laszlo Valaszkai, Solvesborg (SE); Esad Celik, Solvesborg (SE)

(73) Assignee: Valeo Engine Cooling AB (SE)

( * ) Notice: Subject to any disclaimer, the term of this patent is extended or adjusted under 35 U.S.C. 154(b) by 0 days.

(21) Appl. No.: 09/595,038

(22) Filed: Jun. 15, 2000

(30) Foreign Application Priority Data

Jun. 18, 1999 (SE) ..... 9902326

(51) Int. Cl.[7] ..... F28F 1/42; F28F 13/12; F28D 1/053

(52) U.S. Cl. ..... 165/177; 165/109.1; 165/153; 165/179

(58) Field of Search ..... 165/153, 177, 165/179, 183, 109.1, 133; 138/38

(56) References Cited

U.S. PATENT DOCUMENTS

| | | | | |
|---|---|---|---|---|
| 1,840,318 A | | 1/1932 | Horvath | |
| 2,017,201 A | * | 10/1935 | Bossart et al. | 154/177 X |
| 4,262,659 A | * | 4/1981 | Brzezinski | 165/170 |

(Continued)

FOREIGN PATENT DOCUMENTS

| | | | | |
|---|---|---|---|---|
| DE | 19548495 A1 | | 6/1997 | |
| DE | 19819248 | | 4/1999 | |
| EP | 0159685 | | 10/1985 | |
| EP | 0590945 | | 4/1994 | |
| EP | 0774637 | | 5/1997 | |
| EP | 0907062 | | 7/1999 | |
| FR | 489717 | | 3/1919 | |
| FR | 2085226 | | 12/1971 | 165/153 |
| FR | 2757258 A1 | | 6/1998 | |
| GB | 521285 | * | 5/1940 | 165/167 |
| GB | 2090651 | | 7/1982 | |
| GB | 2159265 | | 11/1985 | |
| JP | 58-140597 | * | 8/1983 | 165/153 |
| JP | 1-142393 | * | 6/1989 | 165/179 |
| JP | 01-184399 | | 7/1989 | |
| JP | 10193014 | | 7/1998 | |

OTHER PUBLICATIONS

Carl–Olof Olsson, "Thermal and Hydraulic Performance of Enhanced Rectangular Tubes For Compact Heat Exchanger," Chalmers University of Technology, Goteborg, Sweden, Department of Thermo– and Fluid Dynamics, 1997.

*Primary Examiner*—Leonard R. Leo
(74) *Attorney, Agent, or Firm*—Morgan & Finnegan, LLP

(57) ABSTRACT

A fluid conveying tube included in a vehicle cooler comprises on its inside first and second opposite longitudinal primary heat exchange surfaces, and flow-directing surface structures which are arranged on the primary surfaces. Each surface structure comprises a plurality of elongate directing elements projecting from the primary surfaces. The surface structures are alternatingly arranged on the first and second primary surfaces in such manner that directing elements, succeeding in the longitudinal direction of the primary surfaces, are alternatingly arranged on the first and second primary surfaces and are mutually inclined at a given angle (γ). Each surface structure comprises a laterally extending row of mutually parallel directing elements. Thus an input fluid flow is divided into a number of parallel partial flows which follow a respective spiral-shaped flow path through the tube, whereby a high heat exchanging capacity is achieved.

19 Claims, 3 Drawing Sheets

U.S. PATENT DOCUMENTS 4,470,452 A 9/1984 Rhodes ..... 165/153
5,125,453 A * 6/1992 Bertrand et al. ..... 165/153
5,186,251 A 2/1993 Joshi
5,441,106 A 8/1995 Yukitake
5,579,837 A 12/1996 Yu et al.
5,689,881 A 11/1997 Kato
5,730,213 A 3/1998 Kiser et al.
5,768,782 A 6/1998 Kato
5,890,288 A 4/1999 Rhodes et al.
5,934,128 A 8/1999 Takiura et al.
6,067,712 A 5/2000 Randlett et al.
6,209,202 B1 4/2001 Rhodes et al.
6,510,870 B1 * 1/2003 Valaszkai et al. ..... 138/38
6,513,586 B1 2/2003 Haussmann
6,550,533 B2 4/2003 Nakado et al.

* cited by examiner

FLUID CONVEYING TUBE AND VEHICLE COOLER PROVIDED THEREWITH

TECHICAL FIELD

The present invention generally relates to vehicle coolers, and in particular to the design of fluid conveying tubes included in such coolers.

BACKGROUND ART

One type of vehicle cooler, which is, for instance, disclosed in EP-A1-0 590 945, comprises a heat exchanger assembly which is made up of, on the one hand, flat fluid conveying tubes, which are juxtaposed to be passed by a first fluid, for instance, liquid circulating through an engine block and, on the other, surface-enlarging means arranged between the tubes and adapted to be passed by a second fluid, e.g. cooling air. Each tube has opposite large faces, to which the surface-enlarging means are applied and which form the primary heat exchanging surfaces of the tube.

In this type of coolers, it is already known to provide the primary surfaces on the inside of the tubes with projections with a view to increasing the heat exchange between the fluids. These projections break up the insulating, laminar boundary layer which otherwise tends to form inside the tube along its primary surfaces, at least at low fluid flow rates. The projections can be elongate, as known from e.g. U.S. Pat. No. 4,470,452, or cylindrical, as known from e.g. U.S. Pat. No. 5,730,213. However, these constructions are not capable of combining a sufficiently high heat exchanging capacity with a sufficiently low pressure drop in the longitudinal direction of the tubes.

An alternative embodiment of fluid conveying tubes is disclosed in a doctor's thesis published in 1997 by Chalmers Institute of Technology entitled "Thermal and hydraulic performance of enhanced rectangular tubes for compact heat exchangers". Such a tube is schematically shown in a plan view in FIG. 1. The opposite primary surfaces of the tube have transverse ribs 1 in zigzag, i.e. surface structures which each consist of a number of elongate rib elements 2 which are connected to each other in intermediate pointed areas 3. The transverse ribs 1 are alternatingly arranged in the longitudinal direction L of the tube on the opposite primary surfaces of the tube, the ribs 1 (full lines in FIG. 1) arranged on the upper primary surface being transversely offset relative to the ribs 1 (dashed lines in FIG. 1) arranged on the lower primary surface. Seen in the longitudinal direction L of the tube, the succeeding rib elements 2 are arranged alternatingly on the opposite primary surfaces and have a given mutual angle. Thus, the rib elements 2 will direct the flow of the first fluid through the tube to generate a swirling motion about the longitudinal axis of the tube, as schematically shown in the end view in FIG. 2. More specifically, the input flow is divided into a number of parallel partial flows 4 to which a spiral motion is imparted when passing through the tube, each partial flow 4 having an opposite rotation relative to the adjoining partial flows 4. By means of such partial flows, the boundary layer adjacent to the primary surfaces is broken up and a better circulation of fluid is provided between the centre portions and wall portions of the tube. All this results in a potentially high heat exchanging capacity of the tube. It has, however, been found that it is difficult to provide connected ribs in zigzag shape by means of today's manufacturing technique, and therefore there is in practice a gap in the pointed areas 3 between the rib elements 1.

Vehicle coolers with this type of "spiral-flow tubes" have been found to have a high heat exchanging capacity also at relatively small flows through the tubes, which is often desirable, for instance, in vehicle coolers for truck engines with air charging or boosting, since these vehicles can generate large quantities of heat also at low speeds of the engine.

The above construction is, however, in its infancy, and needs to be further developed to optimise its capacity.

SUMMARY OF THE INVENTION

It is an object of the present invention to provide an improved fluid conveying tube, i.e. a tube which for a given size has a higher capacity of heat exchange and/or a lower pressure drop than ordinary constructions, in particular when relatively small fluid flows are passing through the same.

It is also an object to provide a fluid conveying tube with a small risk of clogging.

Yet another object is to provide a fluid conveying tube which is simple to manufacture.

These and other objects, which will appear from the description below, have now completely or partially been achieved by means of a fluid conveying tube and a vehicle cooler according to the appended claims. Preferred embodiments are defined in the dependent claims.

The inventive construction divides an input fluid flow into a number of partial flows and a swirling motion about a respective axis extending in the longitudinal direction of the tube is imparted to each partial flow. Thanks to the fact that the elongate directing elements in the surface structures are placed in rows which extend laterally over the tube and that the directing elements included in the respective rows are mutually parallel, the directing elements can be packed closer to each other than in previous constructions. As a result, more partial flows can be obtained in the tube for a given width of the primary surfaces of the tube. This has been found to result in a higher heat exchanging capacity than in previous constructions, in particular at small fluid flows through the tube. The inventive tube can easily be provided with suitable directing elements, for instance, by embossing a blank to form elongate recesses or pits in the large faces of the tube.

BRIEF DESCRIPTION OF THE DRAWINGS

Below, the invention and its advantages will be described in more detail with reference to the accompanying schematic drawings, which by way of example, show presently preferred embodiments of the invention.

DESCRIPTION OF PREFERRED EMBODIMENTS

Figure 1:
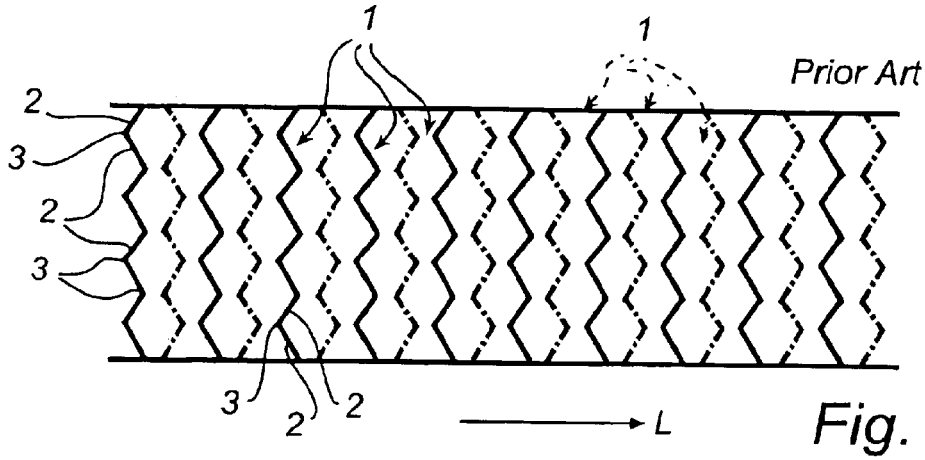
FIGS. 1–2 are a plan view and an end view, respectively, of a fluid conveying tube according to prior-art technique.
Figure 2:
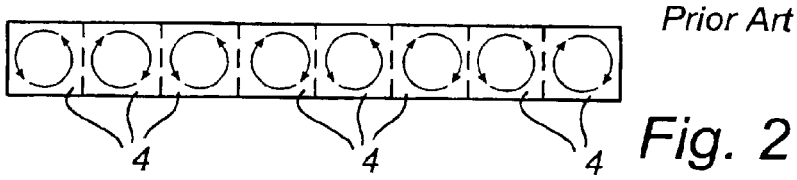
Figure 3:
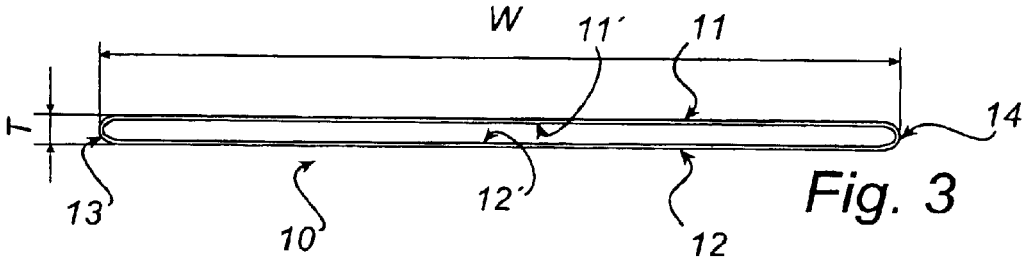
FIGS. 3–8 are different views of a fluid conveying tube according to the invention, FIG. 3 being an end view thereof, FIG. 4 being a plan view of a part thereof, FIG. 5 being a sectional view along the line V—V in FIG. 4, FIG. 6 being a longitudinal sectional view along the line VI—VI in FIG. 4, and FIGS. 7–8 being transverse sectional views along the line VII—VII and VIII—VIII, respectively, in FIG. 4.

FIGS. 3–8 show a preferred embodiment of a fluid conveying tube 10 according to the invention. The tube 10 is suitably made of a metal material, usually an aluminium material. As appears from FIG. 3, the tube 10 is flat and has two opposite large faces 11, 12, which are substantially plane. The large faces 11, 12 are connected via two opposite, curved short sides 13, 14. When the tubes 10 are mounted in a vehicle cooler, surface-enlarging means (not shown), for instance folded laminae, are brought into abutment against the large faces 11, 12. The principal heat exchange between the medium flowing through the tubes 10 and the medium flowing through the surface-enlarging means about the outside of the tubes 10 thus takes place via these large faces 11, 12. The large faces 11, 12 form two opposite primary heat exchange surfaces 11', 12' on the inside of the tube 10. As appears from FIGS. 4–8, the primary surfaces 11', 12' are provided with a number of projecting, flow-directing elements 15, which are called dimples, in the form of small pits on one side of the large faces 11, 12 of the tube 10, said pits forming corresponding projections on the opposite side thereof. These dimples can, for instance, be formed by embossing a blank, which is subsequently formed into the flat tube 10. The height F (see FIG. 6) of a dimple is typically about 0.1–0.3 mm, which substantially corresponds to the material thickness of the tube.

Figure 4:
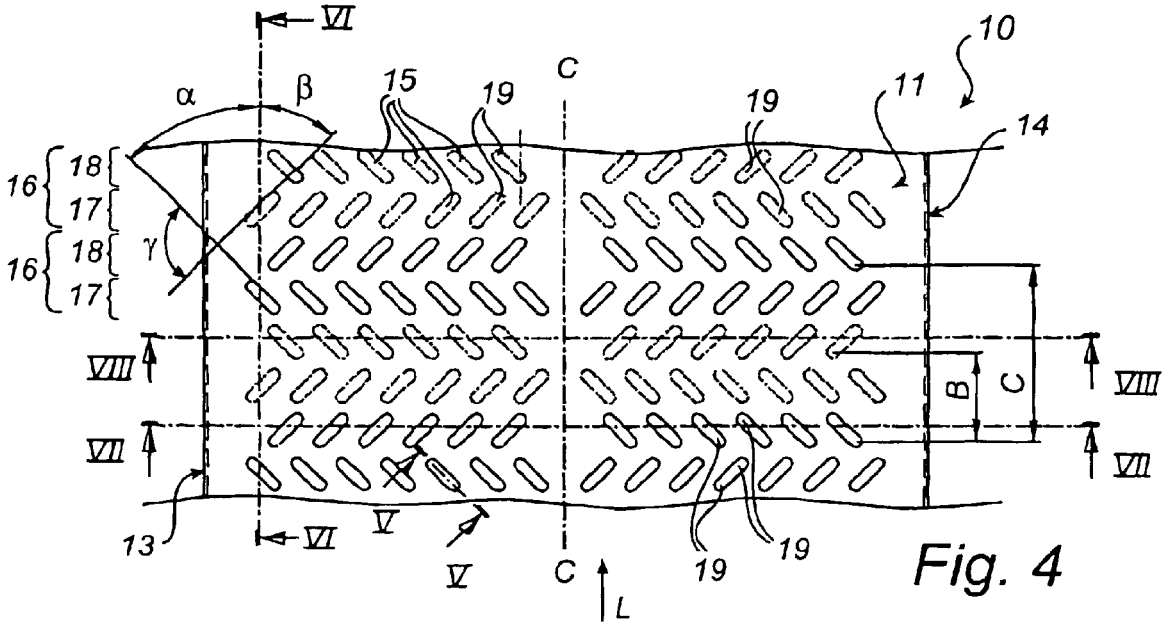
Figure 5:
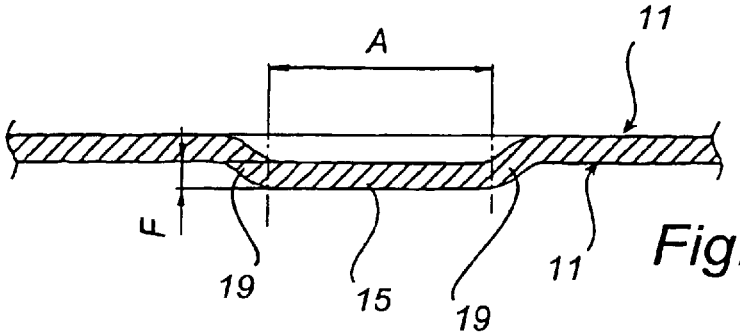
Figure 6:
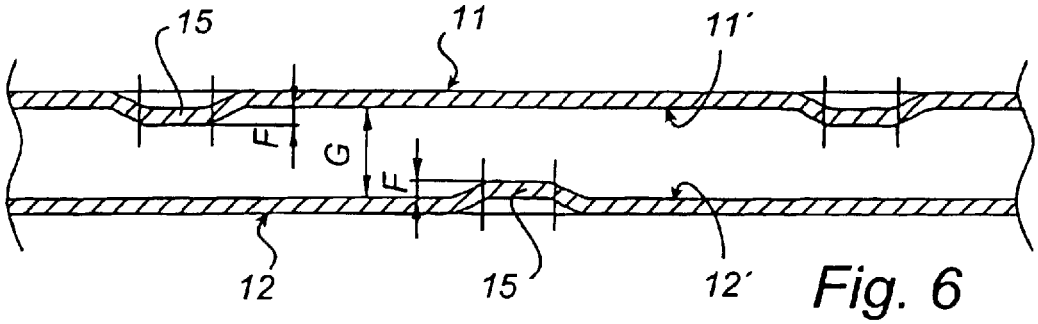
Figure 7:
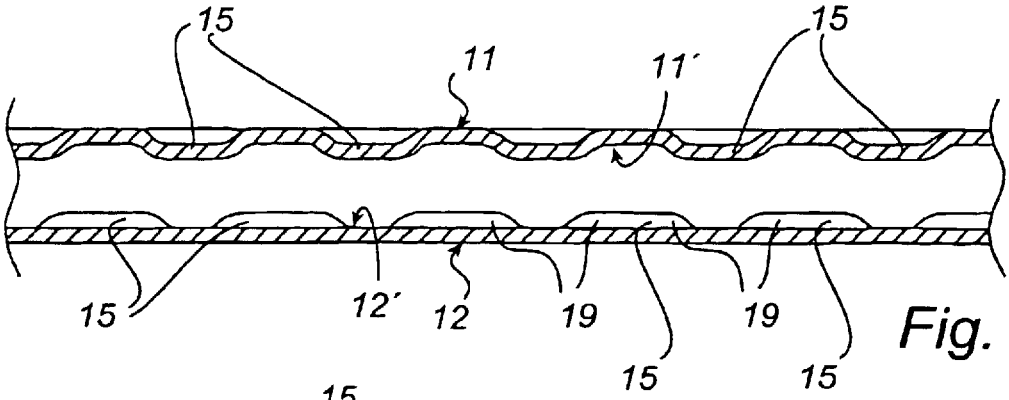
Figure 8:
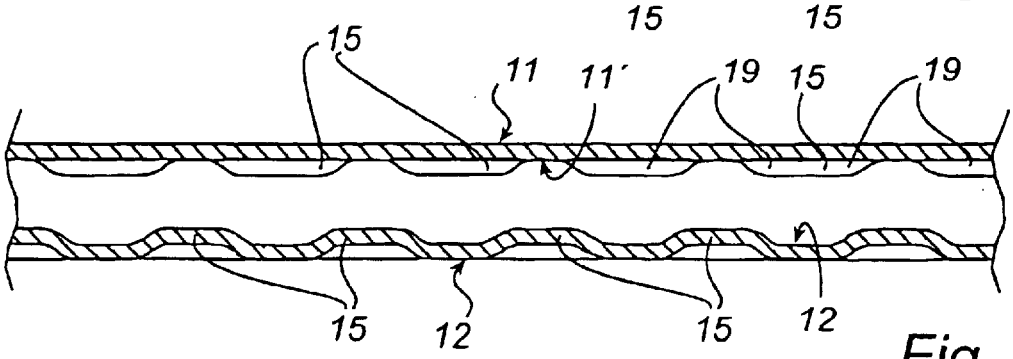

The dimples 15 are elongate and inclined relative to the longitudinal direction L of the tube 10. In addition, the dimples 15 are arranged in a number of surface structures or groups 16 on the respective primary surfaces 11', 12'. FIG. 4 shows the dimples 15 on the upper primary surface 11' in full lines and the dimples 15 on the lower primary surface 12' in dashed lines. Below, the groups 16 of dimples 15 on the left-hand side of the centre line C—C of the tube 10 will first be discussed. It is evident from the plan view in FIG. 4 that the groups 16 of dimples 15 on the upper and lower primary surfaces 11', 12' are relatively offset in the longitudinal direction L, so that the tube 10 in cross-section lacks opposite dimples 15 (see FIGS. 6–8). This makes it possible to avoid clogging of the tube 10. The groups 16 of dimples 15 are thus alternatingly arranged on the upper and lower primary surfaces 11', 12' seen in the longitudinal direction L. Each group 16 consists of a first and a second transverse row 17, 18 of inclined dimples 15. Within the respective rows 17, 18 all dimples 15 are mutually parallel. The dimples 15 in the first row 17 are inclined relative to one short side 13 of the tube 10 at an angle $\alpha$ relative to the longitudinal direction L, whereas the dimples 15 in the second row 18 are inclined relative to the second, opposite short side 14 of the tube 10 at an angle $\beta$ relative to the longitudinal direction L. The dimples 15 in the first row 17 and the dimples 15 in the second row 18 thus have a mutual inclination angle of $\gamma=180°-\alpha-\beta$. Furthermore, the dimples 15 in the second row 18 are laterally offset relative to the dimples 15 in the first row 17, suitably such that the ends 19 of the dimples 15 in the first row 17, seen in the longitudinal direction L, are located in alignment with the ends 19 of the dimples 15 in the second row 18. Seen in the longitudinal direction L, i.e. in the main flow direction of a fluid through the tube 10, succeeding dimples 15 are alternatingly arranged on the upper and lower primary surfaces 11', 12', at least along a line through the centre of the dimples 15 (cf. the line VI—VI in FIG. 4). Moreover, such succeeding dimples 15 are mutually inclined at an angle $\gamma$.

In a fluid conveying tube according to FIGS. 3–8, an input flow of a fluid will be divided into a number of partial flows, to which, while directed by the inclined dimples 15, is imparted a swirling motion about a respective axis extending in the longitudinal direction L of the tube 10. Each set of dimples 15 parallel with the longitudinal direction L of the tube 10 thus forms a virtual channel, in which the fluid performs a spiral motion. Thanks to the fact that the dimples 15 in the respective rows 17, 18 are mutually parallel, they can be placed in a compact pattern on the primary surfaces 11', 12' but still form well-defined virtual channels for the input fluid.

In the embodiment according to FIGS. 3–8, the tube 10 has groups 16 of dimples 15 on both sides of its centre line C—C, but for reasons of manufacture there are no dimples 15 in the area round the actual centre line C—C. The reason for this is that today's manufacturing technique requires the application of an abutment member centrally on the blank during the embossment of the same. Furthermore, in the shown example the dimples 15 in the groups 16 on each side of the centre line C—C are mutually mirror-inverted. It should, however, be noted that the groups 16 can have the same appearance on both sides of the centre line C—C. If admitted by the manufacturing technique, it is actually preferred that the dimples 15 extend continuously transversely of the primary surfaces 11', 12' between the short sides 13, 14. It should, however, be noted that the rows 17, 18 of dimples 15 do not have to extend perpendicularly to the longitudinal direction L of the tube 10, but can also extend obliquely over the surfaces 11', 12'.

It has been found that the dimensioning and positioning of the dimples 15 on the primary surfaces 11', 12' of the tube 10 influence the capacity of the tube 10 as concerns the heat exchanging capacity and pressure drop. Parameters which have been investigated are the angles of inclination $\alpha$ and $\beta$ of the dimples 10 (see FIG. 4), the distance B between succeeding dimples 10 in the longitudinal direction L (see FIG. 4), the distance C between succeeding dimples 15 on the respective primary surfaces 11', 12' in the longitudinal direction L (see FIG. 4), the height F of the dimples 15 from the primary surfaces 11', 12' (see FIG. 5) and the length A of the dimples 15 (see FIG. 5).

It has then been found that the angles $\alpha$ and $\beta$ are preferably equal. Furthermore, the angles $\alpha$ and $\beta$ should be in the range of about 40–80°, and preferably in the range of about 45–75°. Currently, the most preferred value of $\alpha$ and $\beta$ is about 45°, which means that succeeding dimples are substantially mutually perpendicular.

Furthermore, it has been found that suitably the distance C is twice the distance B, i.e. that all dimples 15 succeeding in the longitudinal direction L of the tube 10 have a constant mutual centre-to-centre distance.

When the tube 10 is to be passed by a fluid in the form of a liquid, e.g. water, the following preferred dimensions have been found. For a liquid flowing through the tube at a mean rate of about 0.8–2.2 m/s, the relation between the distance B and the height F of the dimples 15 should be in the range of about 10–40, and preferably about 15–30. At the minimum limit value, the pressure drop along the tube will be undesirably high, and at the maximum limit value the heat exchanging capacity through the primary surfaces will be unsatisfactorily low. In a tube 10 having a distance G between the primary surfaces 11', 12' of 0.8–2.8 mm, the relation between the length A of the dimples 15 and height F of the dimples 15 should be in the range of about 4–14. At the minimum limit value, the pressure drop along the tube 10 will be undesirably high, and at the upper limit value the heat exchanging capacity through the primary surfaces 11', 12' will be unsatisfactorily low. Furthermore, the relation between the mutual distance G of the primary surfaces 11', 12' and the height F of the dimples 15 should be at least about 2.5. This is preferred in tubes having a mutual distance between the primary surfaces 11', 12' of 0.8–2.8 mm in order to avoid clogging when a liquid flows through the tube at a mean rate of about 0.8–2.2 m/s.

When the tube is to be passed by a fluid in the form of a gas, e.g. air, it has been found that the relation between the distance B and the height F of the dimples 15 should be in the range of about 25–65, and preferably about 35–55. At the minimum limit value, the pressure drop along the tube will be undesirably high, and at the maximum limit value the heat exchanging capacity through the primary surfaces will be unsatisfactorily low.

Figure 9:
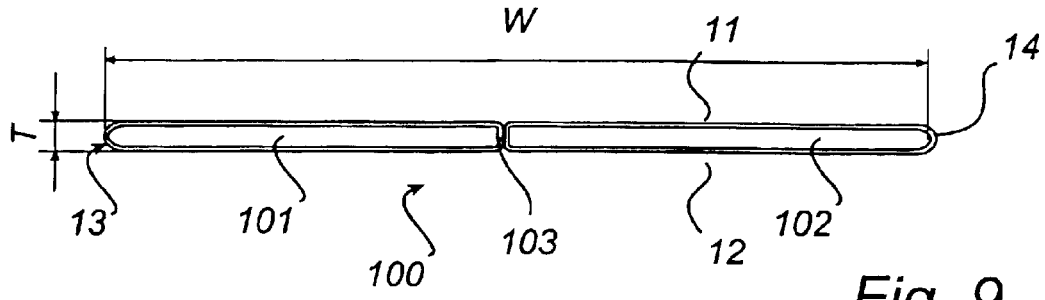
FIGS. 9–10 are an end view and a plan view, respectively, of an inventive fluid conveying tube of dual-channel type.
Figure 10:
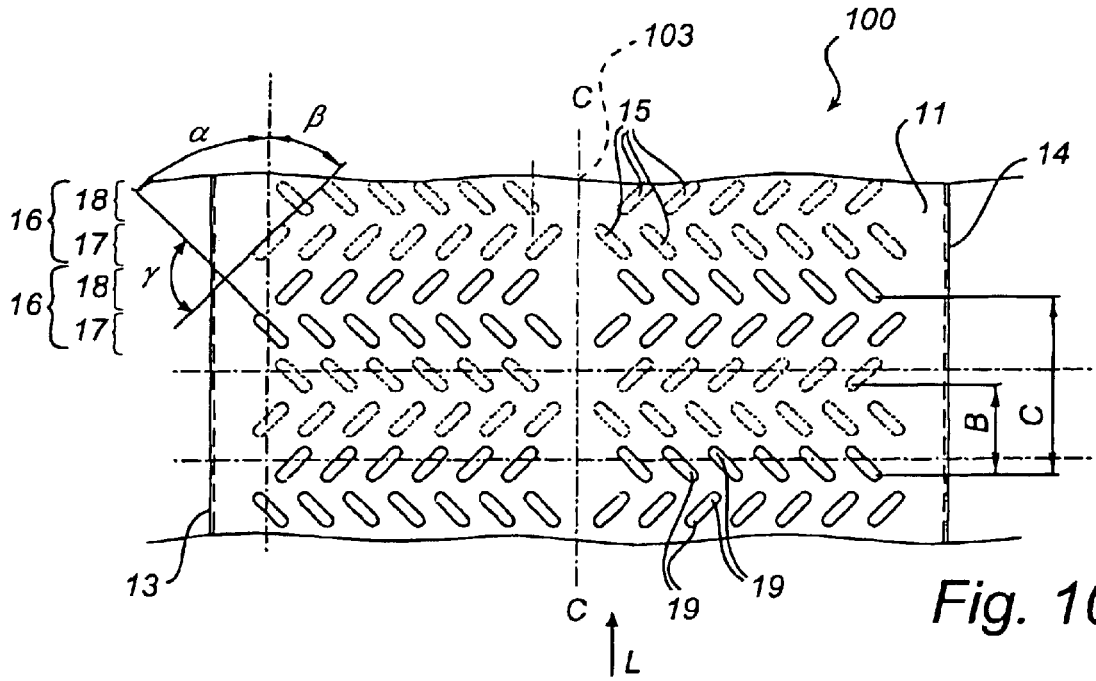

FIGS. 9–10 show an alternative embodiment of a fluid conveying tube. Parts having corresponding parts in FIGS. 3–4 have the same reference numerals and are not described in more detail. The tube 100 contains two separate fluid ducts or channels 101, 102 which are separated by a partition wall 103. The tube 100 is suitably formed by bending a blank provided with dimples. The pattern of dimples 15 on the large faces 11, 12 of the tube 100 is substantially identical with the pattern on the tube 10 in FIG. 4, and therefore corresponding advantages are achieved.

It should be noted that the inventive tube is applicable to all types of vehicle coolers having tubes arranged in parallel for cooling fluids, i.e. liquids or gases, such as liquid coolers, charge-air coolers, condensers and oil coolers.

What we claim and desire to secure by Letters Patent is:

1. A fluid conveying tube for vehicle coolers, which on its interior comprises:

first and second opposing longitudinal primary heat-exchange surfaces, said surfaces having flow-directing surface structures;

each surface structure extending laterally across said primary surfaces, each surface structure comprising at least one row of elongate directing elements, said elongate directing elements being arranged obliquely with respect to the longitudinal direction of the primary surfaces, said elongate directing elements in each row being mutually parallel;

said surface structures being alternatingly arranged in the longitudinal direction on the first and second primary surfaces, the directing elements in each laterally extending row of each surface structure being substantially parallel to the directing elements in the succeeding row of the succeeding surface structure on the opposing primary surface in the longitudinal direction of the tube;

said surface structure further comprising a laterally extending second row of mutually parallel directing elements, the directing elements of the second row being arranged at an angle (γ) relative to the directing elements of the first row;

wherein for a plurality of the mutually parallel directing elements in at least one of the first row and the second row, a corresponding plurality of lines tangent to corresponding elongated edges of each of the plurality of mutually parallel directing elements intersect a tip of a corresponding directing element in the other of the first and second rows.

2. A fluid conveying tube as claimed in claim 1, wherein at least one end of each directing element in said surface structure is arranged, seen in the longitudinal direction of the primary surfaces, essentially in alignment with one end of another directing element in said surface structure.

3. The fluid conveying tube as claimed in claim 1, wherein at least one end of each directing element of the first row is arranged, seen in the longitudinal direction of the primary surfaces, essentially in alignment with one end of an associated directing element of the second row.

4. The fluid conveying tube as claimed in claim 1, wherein the directing elements are laterally relatively offset in the first and second rows.

5. A fluid conveying tube as claimed in claim 1, wherein said angle (γ) is about 20–100.

6. A fluid conveying tube as claimed in claim 1, which is designed to be passed by a liquid, wherein the center-to-center distance between directing elements succeeding in said longitudinal direction is about 10–40 times as large as the height of the directing elements perpendicularly to the primary surfaces.

7. A fluid conveying tube as claimed in claim 1, which is designed to be passed by a gas, wherein the center-to-center distance between directing elements succeeding in said longitudinal direction is about 25–65 times as large as the height of the directing elements perpendicularly to the primary surfaces.

8. A fluid conveying tube as claimed in claim 1, wherein each elongate directing element has a length which is about 4–14 times as large as its height perpendicularly to said primary surface.

9. A fluid conveying tube as claimed in claim 1, wherein the distance between said primary surfaces is at least about 2.5 times as large as the height of the directing elements perpendicularly to said primary surfaces.

10. A fluid conveying tube as claimed in claim 1, wherein said surface structures are arranged and designed to form a number of parallel flow paths which extend through the tube and in each of which a swirling motion about a respective axis extending in said longitudinal direction is imparted to a fluid flowing through the tube.

11. A vehicle cooler comprising a heat exchanger assembly and at least one tank connected to the heat exchanger assembly, wherein the heat exchanger assembly comprises fluid conveying tubes according to claim 1 and surface enlarging means arranged between the tubes.

12. A fluid conveying tube as claimed in claim 1, wherein said angle (γ) is about 30–90.

13. A fluid conveying tube as claimed in claim 1, wherein said angle (γ) is about 90.

14. The fluid conveying tube as claimed in claim 1, which is designed to be passed by a liquid, wherein the center-to-center distance between directing elements succeeding in said longitudinal direction is about 15–35 times as large as the height of the directing elements perpendicularly to the primary surfaces.

15. A fluid conveying tube as claimed in claim 1, which is designed to be passed by a gas, wherein the center-to-center distance between directing elements succeeding in said longitudinal direction is about 30–55 times as large as the height of the directing elements perpendicularly to the primary surfaces.

16. The fluid conveying tube for vehicle coolers in claim 1, wherein:

lines tangent to respective elongated edges of each of the mutually parallel directing elements in said one of the first and second rows intersect respective tips of directing elements in the other of the first and second rows.

17. The fluid conveying tube for vehicle coolers in claim 1, wherein:

the first row has n mutually parallel directing elements, the second row has k>n mutually parallel directing elements, and a corresponding plurality of lines tangent to corresponding elongated edges of the n mutually parallel directing elements in the first row intersects a tip of a respective one of the k mutually parallel directing elements of the second row.

18. The fluid conveying tube for vehicle coolers in claim 1, wherein:

the first row has n mutually parallel directing elements, the second row has k>n mutually parallel directing elements, and a respective line tangent to each of the n mutually parallel directing elements in the first row intersects a tip of a respective one of the k mutually parallel directing elements of the second row, and a respective line tangent to n of the k mutually parallel directing elements in the second row intersects a respective one of the n mutually parallel directing elements in the first row.

19. A method of effecting heat transfer in a heat exchanger, comprising:

introducing a plurality of partial flows into a heat exchanger tube with first and second opposing longitudinal primary heat-exchange surfaces, the tube defining a longitudinal axis and imparting to each of said partial flows a swirling motion about the longitudinal axis through elongated directing elements situated on said first and second heat-exchange surfaces in a first row and a second row substantially parallel, wherein for a plurality of the mutually parallel directing elements in at least one of the first row and the second row, a corresponding plurality of lines tangent to the corresponding elongated edges of each of the plurality of mutually parallel directing elements intersects a tip of a directing element in the other of the first and second rows.

* * * * *